United States Patent [19]

Zimmerman et al.

[11] Patent Number: 4,470,465

[45] Date of Patent: Sep. 11, 1984

[54] BALL TYPE SHUT IN TOOL

[75] Inventors: John C. Zimmerman, Duncan, Okla.; William P. Bellenger, Houston, Tex.

[73] Assignee: Halliburton Company, Duncan, Okla.

[21] Appl. No.: 487,656

[22] Filed: Apr. 22, 1983

[51] Int. Cl.[3] ..... E21B 34/12

[52] U.S. Cl. ..... 166/332; 166/334

[58] Field of Search ..... 166/332–334, 166/373, 386, 51, 278, 323; 251/352

[56] References Cited

U.S. PATENT DOCUMENTS

| | | | |
|---|---|---|---|
| 3,356,140 | 12/1967 | Young | 166/128 |
| 4,051,899 | 10/1977 | Fredd | 166/332 X |
| 4,344,602 | 8/1982 | Arendt | 166/323 X |
| 4,372,391 | 2/1983 | Barrington et al. | 166/373 |

*Primary Examiner*—James A. Leppink
*Assistant Examiner*—Thuy M. Bui
*Attorney, Agent, or Firm*—Joseph A. Walkowski; Thomas R. Weaver

[57] ABSTRACT

A ball valve type shut in tool having utility in gravel packing operations. The tool comprises a tubular housing having a mechanically actuated valve ball disposed therein. The ball is locked in an open or closed mode by the force of a ring spring expanding into two longitudinally spaced annular recesses in the housing. The ball is moved between an open and a closed mode by an operating sleeve comprising spring fingers which is disposed at the end of a wash pipe or production string. Insertion of the operating sleeve into the tool opens the ball; withdrawal of the operating sleeve from the tool closes the ball.

4 Claims, 6 Drawing Figures

BALL TYPE SHUT IN TOOL

BACKGROUND OF THE INVENTION

In the petroleum industry, many producing zones in wells comprise an unconsolidated sand or sandstone type formation having petroleum within. Were an operator to permit the petroleum to flow from the producing zone into the open end of a production string, or into large apertures in the production string, the formation would break down and clog the production string; moreover, the formation could collapse in the vicinity of the well bore "killing" the well by greatly reducing its own permeability and thus damaging it for production purposes due to reduced or terminated petroleum flow.

One way of stabilizing a sand or sandstone type producing zone is to place a "gravel pack" between the formation and the production string. The gravel pack presents a barrier to migrating sand from the formation while permitting fluid flow. To effect a gravel pack in a "single zone" or single producing formation well, a sand screen is suspended at the bottom of a liner from a liner hanger, which in turn is anchored to surrounding well bore casing. If the well is unlined, the sand screen is incorporated in the casing. A sand screen comprises, in one common embodiment, a length of pipe having apertures through the wall thereof, with wires wound around the apertured portion of the pipe in such a fashion as to create only very small intervals between adjacent strands of wire. The wire is generally welded to ribs on the exterior of the apertured portion of the pipe. The bottom of the pipe is closed. The sand screen is of a length greater than the width of the producing zone, and is placed adjacent thereto in the well bore so as to extend above and below the formation.

In the gravel packing operation, drilling mud and other contaminants are usually washed from the well bore, and the formation treated. Common treatments include acidizing to dissolve formation clays, and injecting stabilizing gels to prevent migration of formation components and formation breakdown prior to packing.

In gravel packing a single producing zone, a packer is set above the producing zone between the liner and the casing or between casing and well bore wall, if no liner is employed. A tubing string is run inside a liner assembly (or casing) to a level just above the zone, and a gravel slurry is pumped down the tubing/liner (or casing) annulus out into the annulus between the liner and casing or casing and well bore wall. The "gravel," which in many instances is merely a very coarse grade of sand itself, is sized so as to be larger than the distance between the wires of the sand screen, thereby being deposited on the outside of the screen and settling into a "pack" as the slurry carrier fluid enters the screen and is returned to the surface, generally by using a crossover tool.

After a period of time, the gravel pack builds up around the sand screen until it reaches a level higher than that of the highest screen apertures. At that point, pumping pressures at the surface become noticeably higher, and the slurry pumping operation is stopped. If desired, the return tubing string can then be shut (or the crossover closed if one is employed) and pressure applied in the same direction as the slurry flow, to squeeze the pack into the formation to consolidate the pack. After squeezing, the crossover tool is opened and a clean fluid is "reverse circulated" by pumping down the tubing string to the level of the gravel pack inside the sane screen and back up to the surface to flush out the interior of the sand screen. Subsequently, the well may be subjected to other treatments if necessary, and produced.

Once the well has been gravel packed, however, the operator must choose between using the tubing string with crossover tool in place for production, and removing it and inserting a simple production string. If the latter approach is taken, there is no downhole closure of the producing zone while the tubing is out of the well. Prior art shut in devices are known, but these prohibit entry of a wash pipe down into the sand screen area, a desirable feature during reverse circulation. Furthermore, prior art shut in devices do not provide for automatic closure when the tubing string is removed. Finally, prior art devices are not susceptible to operation by a production string inserted after the tubing string is removed, as the shut in devices of the prior art are connected to the tubing string.

SUMMARY OF THE INVENTION

In contrast to the prior art, the shut in tool of the present invention provides a versatile and virtually fail-safe device for closing in a producing zone downhole between the removal of the tubing string and insertion of the production string. The shut in tool of the present invention comprises a tubular housing containing a ball valve. The valve ball is rotated between an open and closed mode by the longitudinal movement of operating arms, each having a knob protruding therefrom which ride in apertures in the exterior of the ball. The operating arm is in turn connected to a tubular stinger guide above the ball in the tool, the stinger guide being longitudinally slidable in the housing and having an annular shoulder projecting from its interior wall. A split locking ring surrounds the stinger guide and is in a compressed state during the longitudinal travel of the stinger guide except when it encounters one of two annular recesses in the housing interior, whereupon it expands to lock the ball in a fully open or fully closed mode. The stinger guide is removed longitudinally by an operating sleeve having spring fingers at the end thereof, the spring fingers having protrusions on their exterior which engage the annular shoulder on the sleeve guide.

In practice, the operating sleeve is initially attached to the wash pipe or tubing string employed in gravel packing. The pipe is run into the shut in tool so that the spring fingers force the stinger guide downward, opening the tool. Increased downward movement on the wash pipe will compress the spring fingers, allowing the wash pipe to be run down through the ball to the bottom of the sand screen, if desired. After gravel packing and other treatments, the wash pipe is removed from the tool, which is automatically closed by the withdrawal of the operating sleeve, thus effecting a shut in downhole near the level of the producing zone. When the operator wishes to produce the well, he places the operating sleeve on the end of the production string, and runs it back into the shut in tool, opening it. Of course, a production packer above the shut in tool seals off the liner/production string annulus.

BRIEF DESCRIPTION OF THE DRAWINGS

The shut in tool of the present invention will be more easily understood by referring to the following detailed description and operation of the preferred embodiment, taken in conjunction with the accompanying drawings, in which.

DETAILED DESCRIPTION AND OPERATION OF THE PREFERRED EMBODIMENT

Figure 1A:
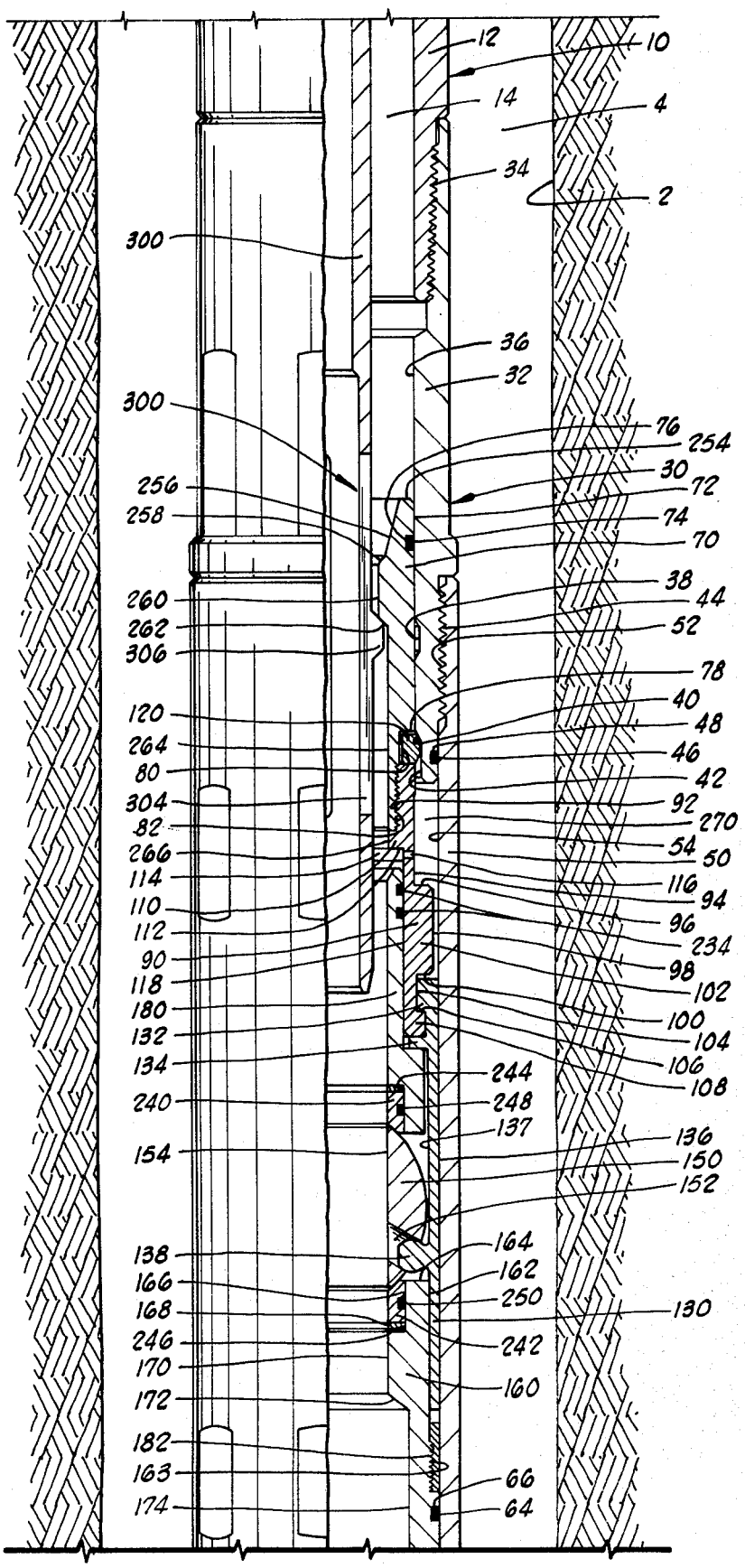
FIGS. 1A and 1B are a vertical full section elevation of the shut in tool of the present invention suspended as part of a liner in a well bore above a sand screen, prior to gravel packing.
Figure 1B:
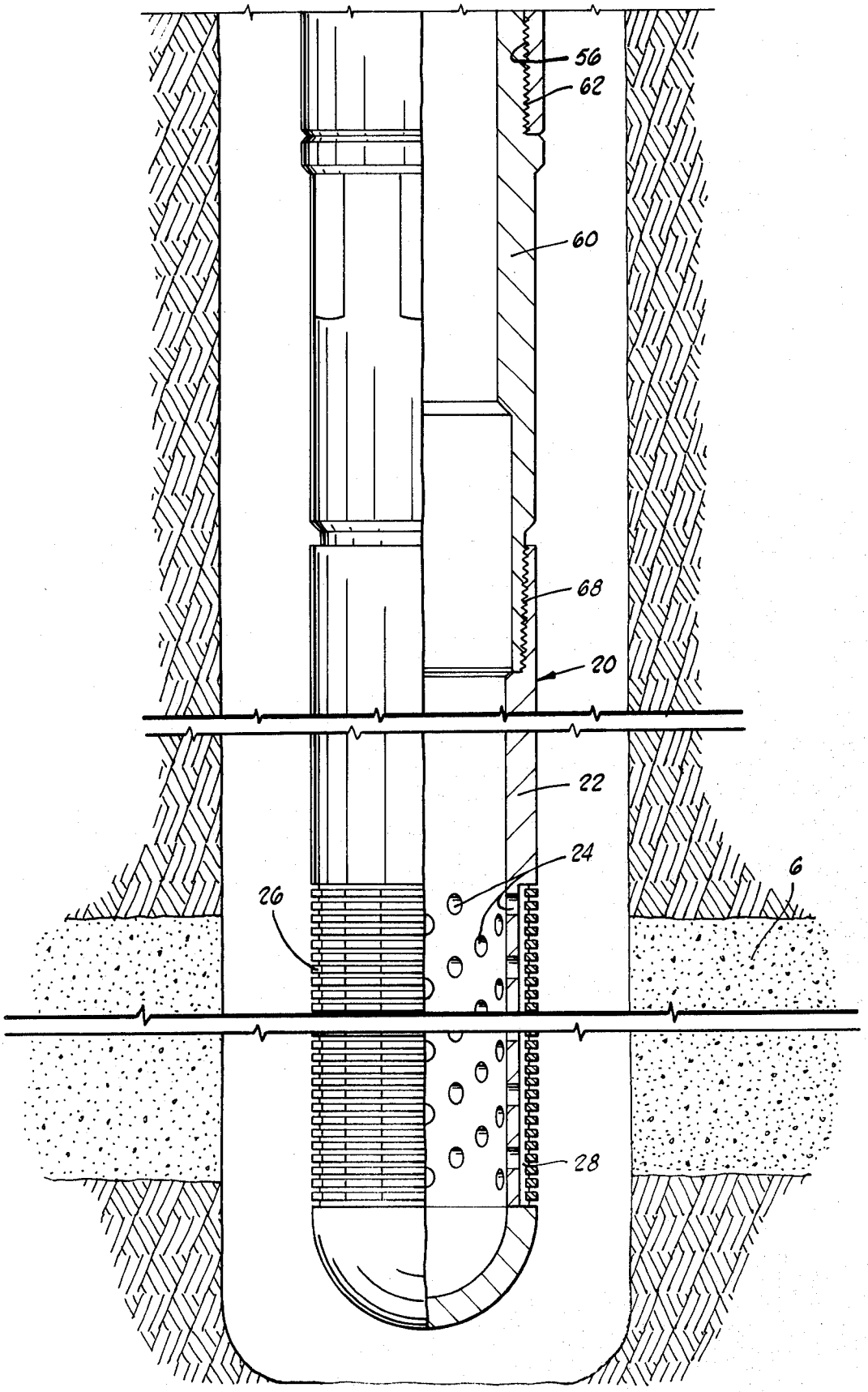

Referring to FIGS. 1A and 1B of the drawings, a detailed description follows of the preferred embodiment of the ball type shut in tool of the present invention. Shut in tool 30 is shown suspended in well bore 4 defined by well bore wall 2 as a part of screen assembly 10, which includes a screen hanger (not shown) from which is suspended liner pipe 12 having bore 14 therein, to which is attached shut in tool 30, from which in turn is suspended sand screen 20 having apertures 24 in the wall 22 thereof, which apertures are surrounded by screen wire 26 welded to ribs 28. Well bore 4 pierces unconsolidated producing zone 6; screen wire 26 and apertures 24 extend above and below producing zone 6. While only a slight overlap of the formation by the sand screen 20 is shown for purposes of illustration, it is understood by those skilled in the art that the actual overlap is much greater in order to assure a stable and effective gravel pack. It should also be understood that in a great many instances, if not the majority, the producing zone to be gravel packed will be supported by casing, which is cemented in the well bore, and then perforated, all by techniques well known in the art, prior to running a sand screen within the casing in the well bore. However, for purposes of clarity, these items have been omitted from the drawing figures herein and in any event are not germaine to an understanding of the present invention.

Ball type shut in tool 30 comprises tubular upper body 32 which is threaded to liner pipe 12 at 34. The interior of upper body 32 is of a substantially constant diameter defined by wall 36 into which annular groove 38 having tapered sides opens, and terminated at its lower end by a short frustoconical surface 40 leading to an area of increased diameter defined by wall 42.

Threads 44 on the exterior of upper body 32 mate with threads 52 on the interior of tubular case 50, O-ring 46 in annular groove 48 creating a seal therebetween. The interior diameter of case 50 is substantially constant from threads 52 downward to threads 56, the intermediate portion being defined by wall 54. Threads 56 engage threads 62 on liner nipple 60 at the bottom of shut in tool 30, an O-ring 64 carried in annular groove 66 creating a seal therebetween. The lower end of liner nipple 60 may be threaded to sand screen 20 at 68 as shown, or another length of pipe may be interposed therebetween.

On the interior of shut in tool 30, stinger guide 70 slides inside of upper body 32. A sliding seal to prevent the incursion of sand or other particular material between inner wall 36 and outer surface 72 of stinger guide 70 is effected by wiper seal 74 carried in annular groove 76 in outer surface 72. At the lower end of stinger guide 70, radially flat wall 78 extends inward to lower surface 80 of reduced diameter, lower surface 80 being threaded at 82 at its lower extent.

Operating arm connector 90, just below stinger guide 70, is connected thereto by threads 92 which mate with threads 82. Split locking ring 120 is carried in the annular space created by radially flat wall 78, lower surface 80 and the upper end of operating arm connector (unnumbered). Locking ring 120 possesses a cross section with an axially oriented interior surface, radially flat sides and an axially oriented exterior surface bounded by tapered sides. Upper surface 94 on the exterior of operating arm connector 90 is of substantially the same diameter as that of surface 72 on stinger guide 70 to permit the upper portion of operating arm connector 90 to slide inside wall 36 of upper body 32.

Below upper surface 94, first radially flat wall 96 extends outward to increased diameter intermediate surface 98, below which a second radially flat wall 100 extends inward to recessed surface 104, annular stop 102 being defined by walls 96, 100 and surface 98. Recessed surface 104 terminates at third radially flat wall 106, extending outward a slight distance to create annular protrusion 108 at the bottom of operating arm connector 90. The interior threads 90 at the top of operating arm connector 90 terminate at annular protrusion 110, below which radially flat wall 112 leads to annular groove 114 onto which opens a plurality of relief ports 116. The interior of operating arm connector 90 below annular groove 114 is of a substantially constant diameter, defined by wall 118.

Two operating arms 130, one of which is shown and the other of which is positioned in mirror-image to the first in the unsectioned half of the tool on the left, interlock with annular protrusion 108 on operating arm connector 90. Upper operating arm lugs 132 extend into the annular recess defined by second radially flat wall 102, recessed surface 104 and third radially flat wall 106. Lower operating arm lugs 134 extend inwardly immediately below annular protrusion 108. Outward movement of operating arm 130 is constrained by inner intermediate wall 54 of case 50. The exterior of operating arm 130 is defined by outer surface 136 and the interior by inner wall 137. Ball lug 138 extends inwardly from inner wall 137 of operating arm 130 into lug recess 152 of ball 150. Another lug recess on the left, unsectioned side of the tool accommodates a second ball lug from the second operating arm. It should be noted that the lower ends of operating arms 130 are confined between the upper end 160 of liner nipple 60 and the inside wall 54 of case 50. The outer surface 162 of upper end 160 is of slightly less diameter than the inside of operating arm 130. Upper end 160 terminates at its upper extent at flat end 164, which leads on the interior of upper end 160 to upper interior surface 166 which extends to radially flat wall 168, leading inward to intermediate interior wall 170, which extends downward to frustoconical wall 172 leading radially outward to lower wall 174. Outer surface 162 of upper end 160 terminates at its lower end at threads 163.

Figure 3A:
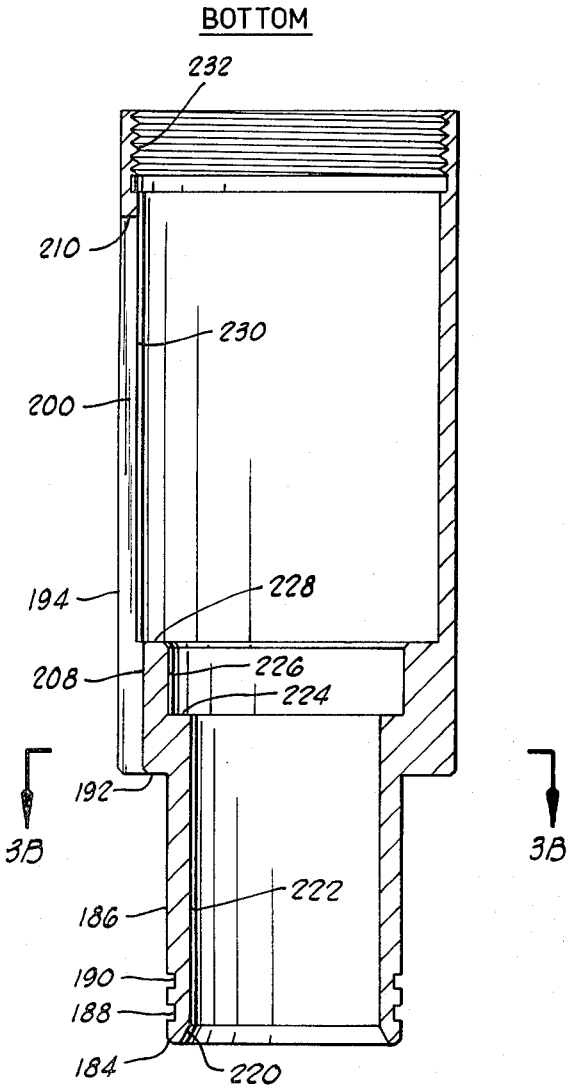
FIGS. 3A and 3B are enlarged sectional views of the connector seat employed in the shut in tool of the present invention.
Figure 3B:
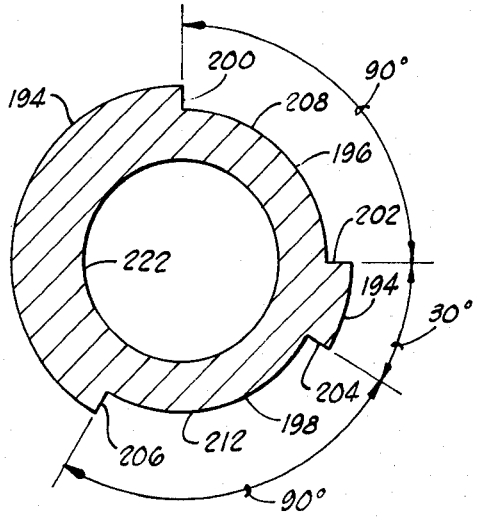

As may not be fully appreciated by viewing FIG. 1 of the drawings, connector seat 180 comprises a substantially tubular piece having two longitudinally-extending sections cut out of the wall thereof, in which operating arms 130 are disposed, the cut out sections acting as a guide to ensure longitudinal movement thereof. Connector seat 180 is threaded to upper end 160 of liner nipple 60 at 182. FIGS. 3A and 3B of the drawings depict the detailed structure of connector seat 180. The exterior of connector seat 180 comprises arcuate annular surface 184 leading to cylindrical surface 186, into which two annular grooves 188 and 190 extend. Cylindrical surface 186 terminates in radially flat wall 192, which leads outward to cylindrical surface 194 of a greater diameter, the latter extending to the lower end of connector seat 180. Two longitudinally extending sections 196 and 198 are cut out of connector seat 180, section 196 being laterally defined by flat edges 200 and 202, and section 198 being laterally defined by flat edges 204 and 206. At the top end of section 196, surface 208 defines the inward radial extent of the depth to which section 196 is cut. The bottom extent of section 196 is defined by radially flat wall 210. Surface 212 defines the inward radial extent of the depth to which section 198 is cut. The bottom extent of section 198 is defined by radially flat wall 214.

On the interior of connector seat 180, frustoconical leading wall 220 leads to cylindrical inner wall 222, which extends to radially flat outward-extending wall 224, which in turn leads to cylindrical wall 226 of a greater diameter. Wall 226 extends to a chamfered edge communicating with radially flat wall 228, extending outwardly to inner cylindrical wall 230. At the end of inner wall 230, a short annular shoulder leads to threads 232. As may be clearly seen in FIG. 3, each cut out section 196 and 198 extends 90° around the circumference of connector seat 180, and the two sections are separated by a 30° arc.

Operating arms 130 are curved in their lateral extent to substantially the same radius of curvature as cut out sections 196 and 198 on connector seat 180; inner wall and outer surface 137 and 136, respectively, of operating arms 130 are of substantially the same curvature as inner cylindrical wall 230 and outer cylindrical surface 194 on connector seat 180. However, while sections 196 and 198 extend approximately 90° circumferentially, operating arms 130 extend only substantially 60° or less circumferentially. With respect to the assembly of tool 30, connector seat 180 is threaded to liner nipple 60, threads 232 on the former mating with threads 163 on the latter. O-ring seals 234 in grooves 188 and 190 in connector seat 180 provide a sliding, fluid-tight seal between outer surface 186 of connector seat and inner wall 118 of operating arm connector 90. Lower operating arm lugs 134 are confined between annular protrusion 108 of operating arm connector 90 and radially flat surface 192 of connector seat 180.

Ball 150 is confined between connector seat 180 and liner nipple 60, ball seats 240 and 242 bracketing ball 150 on its upper and lower sides, respectively.

Ball seats 240 and 242 are biased into contact with ball 150 by backup springs 244 and 246, respectively. The inner curved surfaces of ball seats 240 and 242 are honed to mate with the exterior of ball 150, to provide a seal therewith. A fluid-tight seal between ball seats 240 and 242 and connector seat 180 is effected with O-ring seals 248 and 250, respectively, which seals are contained in annular grooves on the exterior of the ball seats.

On the interior of tool 30, stinger guide 70 has a radially flat leading edge 254, which extends inwardly to frustoconical wall 256, from which annular protrusion 260, having oblique leading and trailing edges 258 and 262, extends inwardly. Below protrusion 260, inner cylindrical wall 264 extends to the end of stinger guide 70. Annular protrusion 110 of operating arm connector 90 has a cylindrical inner wall 266 of substantially the same diameter as surface 264. Inner wall 222 of connector seat 180 is also of substantially the same diameter, as is bore wall 154 of ball 150 as well as the inner walls (unnumbered) of ball seats 240 and 242 and intermediate interior wall 170 of liner nipple 60.

Figure 2A:
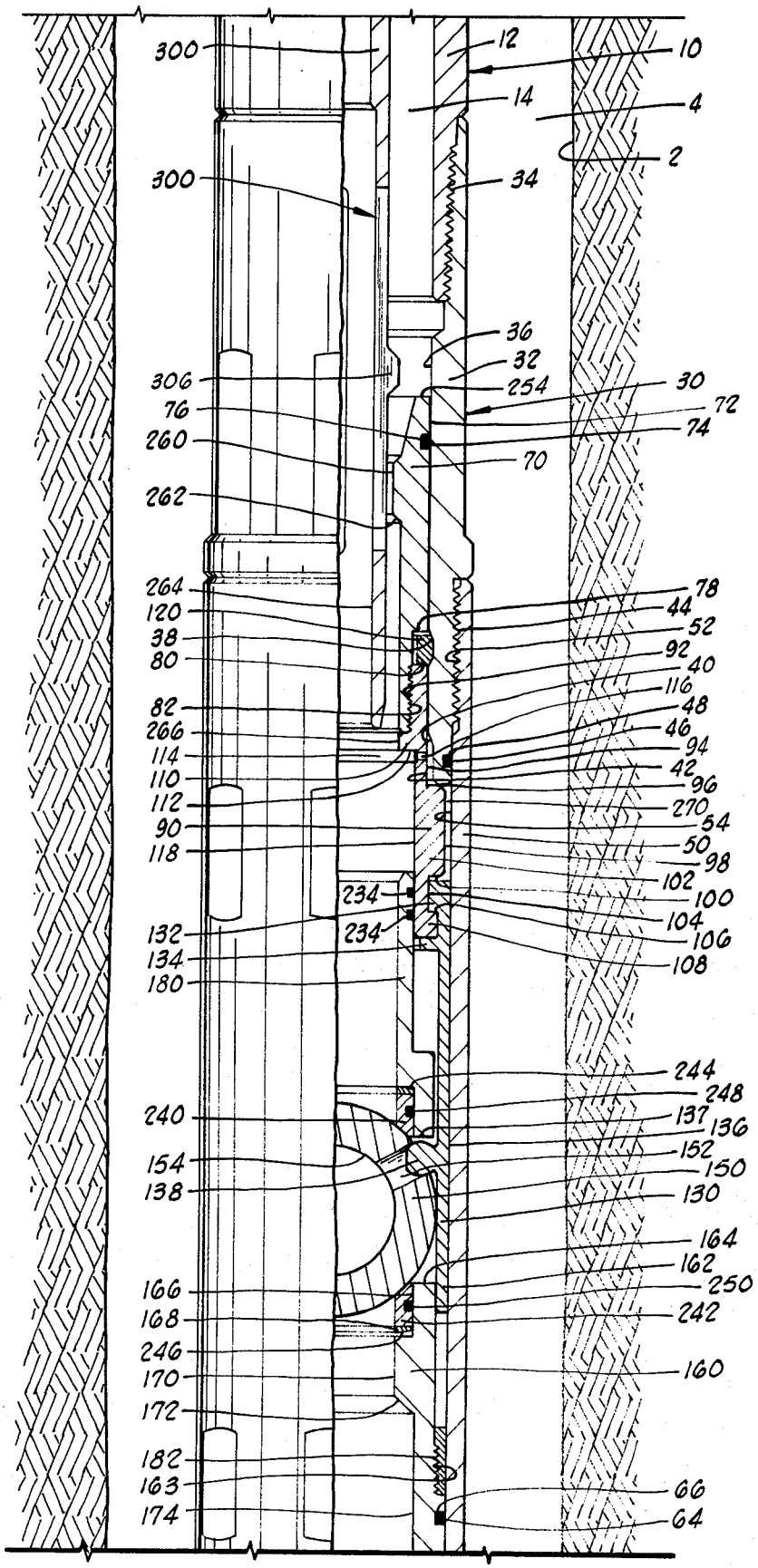
FIGS. 2A and 2B are a vertical half section elevation of the shut in tool of the present invention after the gravel packer has been placed across the producing zone, as the wash pipe is withdrawn from the tool.
Figure 2B:
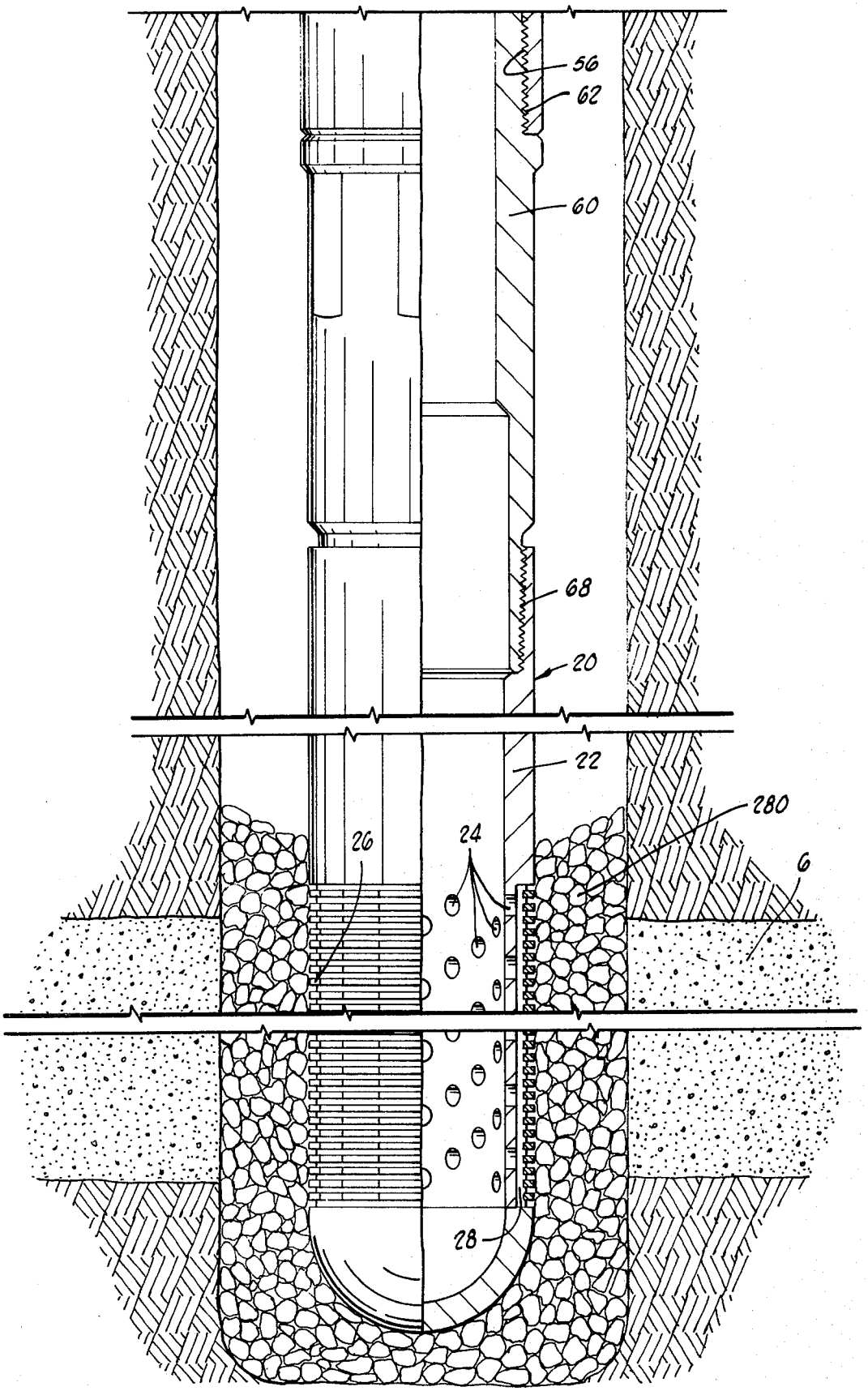

FIGS. 1A, 1B, 2A and 2B, depict the operation of tool 30. Tool 30 is initially run into the well bore as part of a liner, with ball 150 in a closed position as shown in FIG. 2A, split lock ring 120 resting in annular groove 38. To move ball 150 to an open mode, wash pipe 300 having stinger 302 comprising a plurality of spring fingers 304, is run into the liner 12 and into tool 30. Protrusions 306 extend outwardly from spring fingers 304, and contact protrusion 260 on stinger guide 70, forcing it downward as split locking ring 120 is compressed against stinger guide 70 so it may slide out of groove 38. The downward movement of stinger guide 70 moves operating arm connector 90, which in turn slides operating arms 130 downward, the movement of ball lugs 138 causing rotation of ball 150 to an open position. If downward force is continued on wash pipe 300, the spring fingers 304 will compress radially inwardly so as to permit stinger 302 to slip past protrusion 260 and allow wash pipe to travel through tool 30 as low as is desired, even to the level of screen 20.

The gravel packing operation is performed to place pack 280 (FIG. 2B) as previously described in the "Background of the Invention," and wash pipe 300 is withdrawn from tool 30, the action of stinger against protrusion 260 causing operating arm 130 to move upwardly and ball 150 to rotate to its closed mode. The gravel packed zone 6 is now isolated from the surface without other mechanism. When a production string is to be run, the stinger 302 is run at the end of it, and a production packer a distance above stinger 302 to seal off the string/liner annulus. Relief ports 116 prevent pressure lock during the opening and closing of ball 150 by permitting communication between the bore of the tool and annular chamber 270.

Thus, it is apparent that a novel and unobvious ball type shut in tool has been invented. Certain deletions, additions and modifications to the preferred embodiment will be readily apparent to one of ordinary skill in the art. For example, spring collet fingers could be substituted for the split locking ring, as could radially spring-loaded lugs or balls. Moreover, the shut in tool of the present invention may be run as part of a liner or casing string, and has utility wherever a full-bore valve having a mechanical actuation is needed downhole. These and other modifications can be made without departing from the spirit and scope of the invention as hereafter claimed.

We claim:

1. A ball type shut in tool for use in a well bore, comprising:

substantially tubular housing means including an upper body having two longitudinally spaced annular recesses on the bore wall thereof, a case therebelow, and a liner nipple;

a substantially tubular stinger guide slidable inside said housing means and having an annular protrusion on the interior wall thereof;

an operating arm connector secured to said stinger guide and defining an annular recess therewith;

an expandable locking ring contained in said annular recess;

operating arms secured to said operating arm connector, said operating arms being of longitudinal extent and arcuate cross section and having ball lugs inwardly projecting therefrom;

a substantially tubular connector seat having cut out sections through the wall thereof through which said ball lugs extend, said connector seat cut out sections and said operating arms having subtantially the same radius of curvature;

a ball having a substantially diametrically oriented bore therethrough and lug recesses in the exterior thereof adapted to receive said ball lugs;

upper and lower ball seats, said upper ball seat disposed between said ball and said connector seat, and said lower ball seat disposed between said ball and said liner nipple;

said case, said liner nipple and said connector seat defining arcuate recesses adapted to receive the lower portions of said operating arms, said connector seat being secured to said liner nipple and surrounded by said case.

2. The tool of claim 1, further including a stinger adapted to be connected to the end of tubing means, and inserted into said housing means, said stinger comprising a plurality of downwardly oriented circumferentially spaced spring fingers having outward extending protrusions thereon of a radial extent greater than the stinger guide annular protrusion.

3. The tool of claim 1, further including backup springs adapted to urge said upper and lower ball seats against said ball.

4. The tool of claim 1, wherein said ball is closed by rotating said ball to orient its bore perpendicular to the bore of said tool.

* * * * *